United States Patent [19]

Van Leeuwen

[11] Patent Number: 5,048,757

[45] Date of Patent: Sep. 17, 1991

[54] IRRIGATION SPRINKLER WITH AN INTERNAL DRIVE CLUTCH

[75] Inventor: Timothy O. Van Leeuwen, Gardnerville, Nev.

[73] Assignee: Garden America Corporation, Carson City, Nev.

[21] Appl. No.: 334,326

[22] Filed: Apr. 7, 1989

[51] Int. Cl.[5] ..... B05B 3/04

[52] U.S. Cl. ..... 239/205; 239/206; 239/241; 239/242

[58] Field of Search ..... 239/200–206, 239/240, 241, 242, DIG. 1

[56] References Cited

U.S. PATENT DOCUMENTS

| | | | |
|---|---|---|---|
| 3,107,056 | 10/1963 | Hunter | 239/240 |
| 3,383,047 | 5/1968 | Hauser | 239/240 |
| 3,655,132 | 4/1972 | Rosic | 239/240 |
| 3,713,584 | 1/1973 | Hunter | 239/206 |
| 3,934,820 | 1/1976 | Phaup | 239/205 |
| 3,955,764 | 5/1976 | Phaup | 239/206 |
| 4,417,691 | 11/1983 | Lockwood | 239/241 |
| 4,625,914 | 12/1986 | Sexton et al. | 239/206 |
| 4,650,118 | 3/1987 | Saarem | 239/206 |
| 4,681,259 | 7/1987 | Troup et al. | 239/206 |

*Primary Examiner*—Andres Kashnikow
*Assistant Examiner*—Michael J. Forman
*Attorney, Agent, or Firm*—Barry E. Deutsch; J. Bruce Hoofnagle

[57] ABSTRACT

A drive clutch mechanism for a pop-up oscillating irrigation sprinkler which serves to protect the internal components of the sprinkler against forceable rotation of the pop-up assembly by vandals, or others, and which when operated does not disturb the previous setting of the trip mechanism in the sprinkler.

10 Claims, 3 Drawing Sheets

FIG. 3
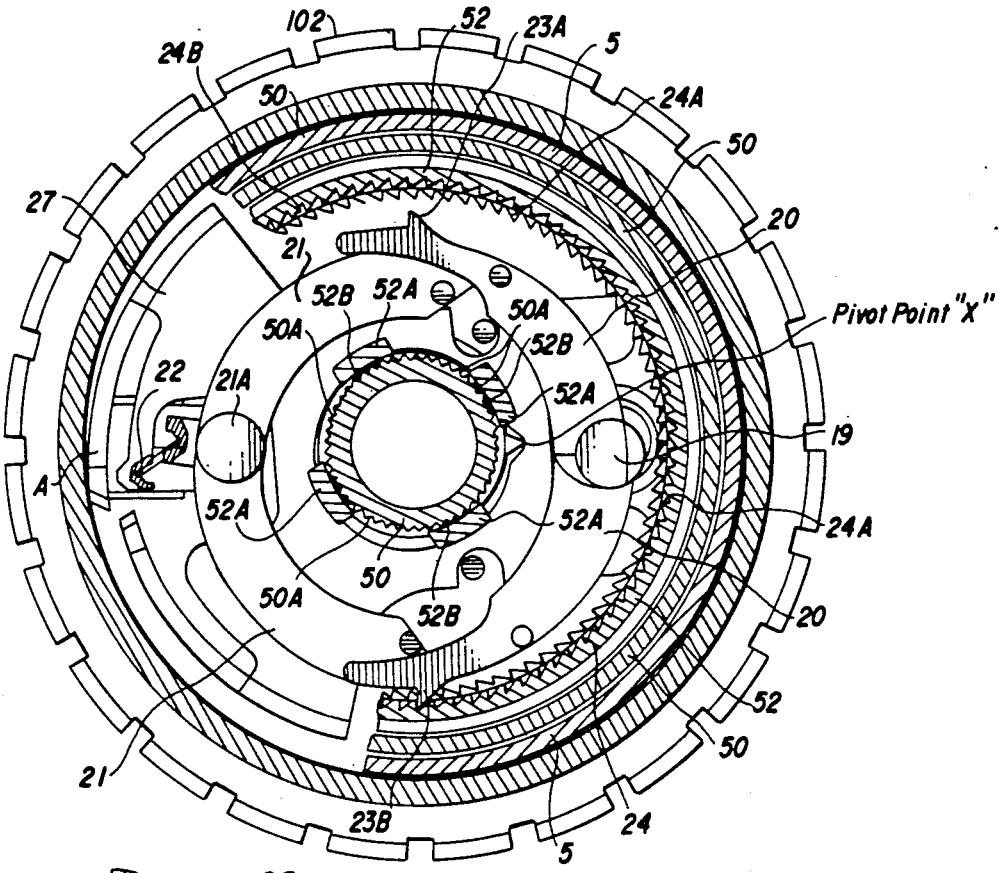
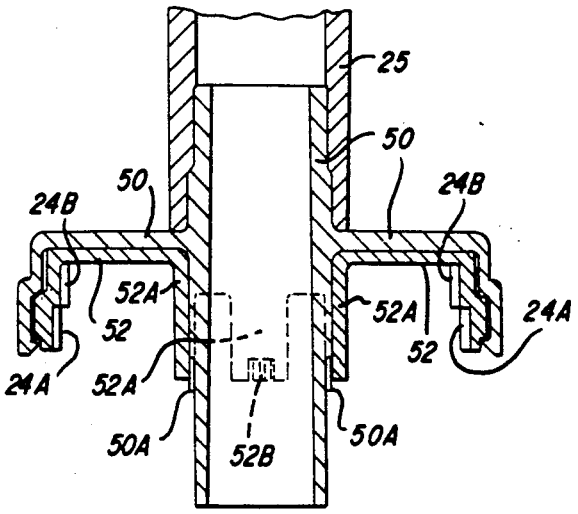
FIG. 4

IRRIGATION SPRINKLER WITH AN INTERNAL DRIVE CLUTCH'

BACKGROUND OF THE INVENTION

Sprinkler heads with rotatable pop-up nozzles propelled by water pressure are presently in widespread use. These heads are capable of discharging relatively large volumes of water over large areas. Many types of self-propelled rotatable sprinkler heads are known to the art. One particular type of such irrigation sprinkler heads, for example, is described in U.S. Pat. No. 4,650,118 which is assigned to the present Assignee. The sprinkler head described in the patent includes a pop-up assembly which is caused to extend up through the cap of the housing against internal spring force by internal water pressure, and in which the extended pop-up assembly is driven by a water-powered motor. A nozzle mounted on the upper end of the pop-up assembly is turned back and forth through a preset arc in order to irrigate a sector of land of a particular size.

The sprinkler described in U.S. Pat. No. 4,650,118 is constructed so that when the pop-up assembly is turned to a particular angular position, a trip tab on the pop-up assembly engages a shifter, and it moves the shifter a small angular increment which in turn engages a pawl and causes the mechanism to reverse so that the pop-up assembly is rotated in the opposite direction to the other end of its preset arc, at which the procedure is repeated by a second trip tab.

The sprinkler head to be described in the present application is of the same general type as the sprinkler head of U.S. Pat. No. 4,650,118. However, it will become evident as the description proceeds that the present invention is not limited to that particular sprinkler head.

An objective of the present invention is to provide a clutch mechanism in the sprinkler head to protect the internal components of the sprinkler in the presence of forced rotation of the pop-up assembly by vandals or others.

Another object of the invention is to provide such a clutch mechanism which, upon operation, does not disturb in any way the previously preset trigger mechanism of the sprinkler head.

BRIEF DESCRIPTION OF THE DRAWINGS

FIG. 3 is a cross-section taken substantially along the line 3—3 of FIG. 2; and FIG. 4 is a simplified schematic diagram of the clutch mechanism which, in accordance with the present invention, is incorporated into the sprinkler head of FIGS. 1-3.

DETAILED DESCRIPTION OF THE ILLUSTRATED EMBODIMENT

Figure 1:
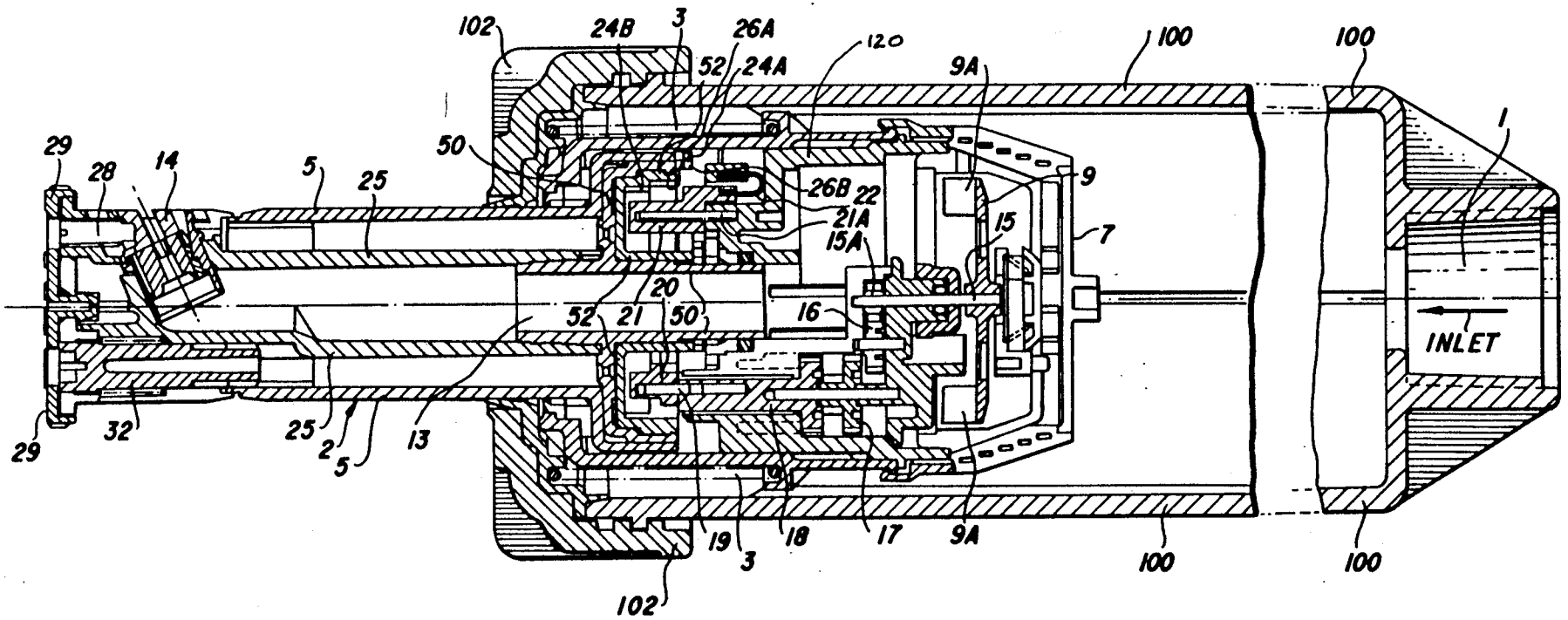
FIG. 1 is a side section of a sprinkler head constructed to incorporate the clutch mechanism of the invention.

The irrigation sprinkler assembly shown in FIG. 1, for example, includes a tubular housing 100 having an inlet 1 at one end through which water under pressure is introduced into the interior of the housing. A pop-up assembly designated generally as 2 is coaxially mounted within the tubular housing for axial movement within the housing from a retracted position to an operational position (shown in FIG. 1) in which the pop-up assembly protrudes through a central opening in a cap 102 mounted on the other end of housing 100. The pop-up assembly is spring-biased to its retracted position by a spring 3, and it is forced into its illustrated operational position by water pressure introduced into the housing 100 through inlet 1. The pop-up assembly 2 includes an outer tubular riser 5 and a coaxial inner tubular riser assembly 25.

A water-driven motor including a rotor 9 is mounted on the inner end of the pop-up assembly. Water is introduced into the motor through a screen filter 7, and the water passes through the motor and through an internal axial passage 13 in the inner riser assembly 25 to a nozzle assembly 14 mounted on the upper end of the inner riser assembly. A cap 29 is mounted on the upper end of the inner riser assembly by a snap fit therewith.

Rotor 9 of the motor is coupled through a drive shaft 15 to a pinion 15A. Pinion 15A drives an idler gear 16 which, in turn, drives an output shaft 18 through a series of reduction gears 17 in a gear box 120. The rotor 9 has a series of rotor blades 9A against which the incoming water pressure is directed and which cause the rotor to rotate. The output shaft drives an axial eccentric pin 19 which operates a pawl 20, shown in FIG. 3.

Pawl 20, as shown in FIG. 3 is engaged by an arcuate follower 21 which is pivotally mounted on a shaft 21A. An over-center spring 22 serves to turn the follower 21 in a first direction to force a projection 23A at one end of pawl 20 into engagement with a first set of teeth 24A; or alternately to turn the pawl so that a tooth 23B at its other end engages a second set of teeth 24B which are positioned adjacent to teeth 24A. The teeth 24A and 24B are oppositely directed, so that when the pawl 20 engages teeth 23A the pop-up assembly is caused to turn in one direction, and when the pawl engages the teeth 23B the pop-up assembly is caused to turn in the opposite direction.

The teeth 24A and 24B are formed on the interior surface of a drive ring member 52 which is coupled to the inner riser assembly 25 through a coaxial tubular member 50. These elements form a protective clutch with the inner riser which will be described in more detail in conjunction with FIG. 4.

Figure 2:
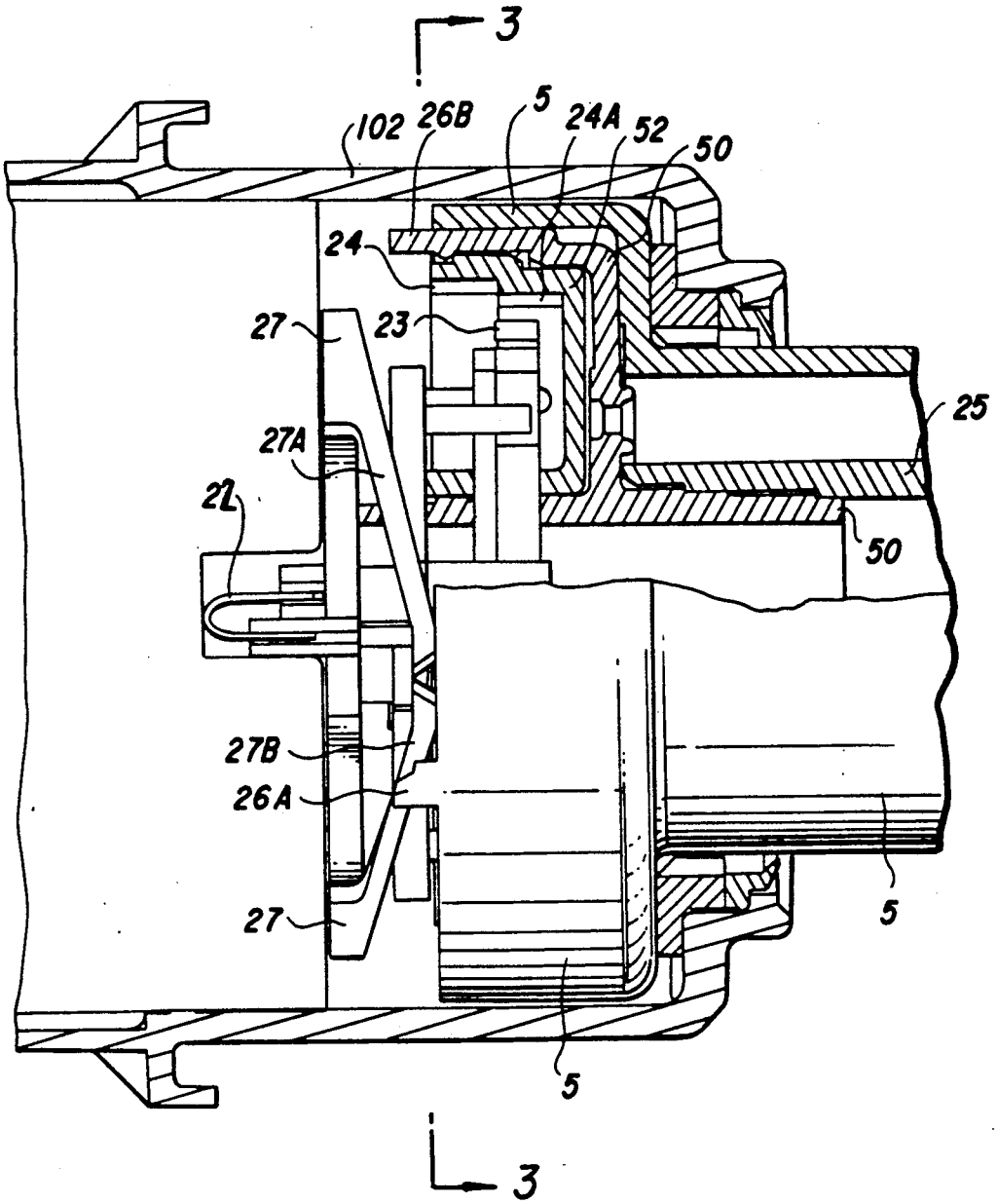
FIG. 2 is a side section of the trip mechanism incorporated into the sprinkler head of FIG. 1.

The follower 21 is moved angularly between its first and second positions by a shifter 27 which is pivotally mounted on the inner end of the gear box 120 at a pivot point X. As best shown in FIG. 2, the outer riser 5 has a trip tab 26A protruding from its lower end, and the tubular member 50 attached to the inner riser assembly 25 has a trip tab 26B protruding from its inner end. The shifter mechanism 27 has a pair of resilient fingers 27A and 27B. Finger 27A is engaged by tab 26A, for example, when the pop-up assembly reaches a particular limiting angular position; and resilient finger 27B is engaged by trip tab 26B when the pop-up assembly is turned to its other limiting position.

When the trip tabs engage the resilient fingers of the shifting mechanism, they cause the shifting mechanism to move from one position to another causing the follower 21 to actuate the over-center spring 22, and thereby moving the pawl assembly 20 from one position to another. The positions of the trip tabs 26A and 26B may be adjusted by controlling the relative angular positions of the inner riser assembly and outer riser 5, and this is achieved by rotating screw 32 (FIG. 1), as will be described in more detail in U.S. Pat. No.

4,919,337, which issued on Apr. 24, 1990, and is assigned to the assignee of record herein.

As described and claimed in Copending application Ser. No. 335,694, filed on Apr. 10, 1989, and assigned to the assigned of record herein, the fingers 27A and 27B of the shifter 27 are resilient, when either trip tab 26A or trip tab 26B is forced against the corresponding resilient finger 27A or 27B of the shifter 27, instead of breaking off the trip tab, the corresponding resilient finger 27A or 27B is forced downwardly enabling the particular trip tab 26A, 26B to pass over the resilient finger. Then, subsequent rotation by the internal motor 9 causes the internal mechanism again to reset itself to its original setting so that the sprinkler may continue to operate without damage.

As shown in FIGS. 3 and 4, the tubular insert 50 has ratchet serrations 50A which engage corresponding ratchet teeth 52B of ratchet beams 52A of drive ring 52. The ratchet beams are formed by angularly spaced axial slots in the drive ring. Drive ring 52, accordingly, is coupled to the tubular insert 50, and hence to the inner riser assembly 25, by a ratchet mechanism which forms a drive clutch between the drive ring 52 and the inner riser assembly 25.

The purpose of the drive clutch mechanism is to protect pawl 20 (FIG. 3) and/or drive ring 52 from damage due to forced rotation of the pop-up assembly by vandals, or others. Such forced rotation causes pawl 20 to attempt to drive the pop up assembly 2 in the opposite direction to the direction of the forced rotation. Since the pawl 20 and drive ring 52 are usually formed of plastic, either or both of these components will be damaged by the forced rotation in the absence of the drive clutch.

The drive clutch protects the pawl and drive ring by creating a slip interface between the inner riser assembly 25 and drive ring 52 in the presence of forced rotation of the pawl assembly. Specifically, during normal operation the drive ring 52 drives the inner riser through the engagement of ratchet teeth, 52B and 50A. However, excessive counter-forces cause the ratchet beams 52A of drive ring 52 to rise up over the ratchet teeth 50A to produce relative movement between the drive ring and the pawl assembly thereby serving to protect the pawl and drive ring from damage.

It will be appreciated that the protective action of the slip clutch mechanism in no way affects the angular displacement of the trip tabs 26A, 26B (FIGS. 1-3) so that the previous setting of the trip points of the sprinkler is undisturbed.

I claim:

1. In a sprinkler head comprising a tubular housing having an inlet at one end, an internal assembly having a first end and a second end with the first end mounted within the housing, a nozzle mounted on the second end of said internal assembly for discharging water over a sector of land to be irrigated in response to water introduced under pressure into the housing through the inlet, said internal assembly including at least one tubular member rotatably mounted in said tubular housing in coaxial relationship therewith, the combination of: a drive ring coaxially mounted with respect to said tubular member; coupling means for positioning said drive ring in positive driving engagement with said tubular member to permit said drive ring to drive said tubular member in a direction for normally discharging water from said nozzle; and drive means mounted in said housing and responsive to water introduced under pressure into the housing for engaging said drive ring to cause said tubular member to turn in said housing, said coupling means forming a drive clutch between said drive ring and said tubular member for removing said drive ring from positive driving engagement in response to forcible rotation of said tubular member with respect to said housing to provide relative rotation between said tubular member and said drive ring so as to protect the said internal assembly.

2. The combination defined in claim 1, in which said coupling means comprises a ratchet mechanism.

3. The combination defined in claim 1, in which said drive ring has a plurality of angularly spaced resilient beams separated by slots formed therebetween wherein said beams are included in said coupling means.

4. The combination defined in claim 3, and which includes ratchet teeth formed in said resilient beams and ratchet serrations formed in said tubular member wherein the ratchet serrations and the ratchet teeth engage one another to form said coupling means, and wherein the ratchet serrations and the ratchet teeth rise up over one another in response to said forcible rotation.

5. The combination defined in claim 1, in which said drive ring has a plurality of drive teeth formed therein, and said drive means includes a pawl.

6. The combination defined in claim 5, in which said internal assembly includes inner and outer tubular risers slidably and rotatably mounted in said tubular housing in coaxial relationship therewith and with one another, and in which said drive ring extends coaxially into said inner riser and is affixed thereto.

7. The combination defined in claim 6, in which said drive ring has first and second pluralities of drive teeth formed therein, and said pawl is movable between first and second angular positions selectively to engage one or the other of said pluralities of drive teeth to cause said internal assembly to turn in one direction or the other in said housing.

8. The combination defined in claim 7, and which includes a reversing mechanism mounted in said housing and movable between first and second positions to cause said pawl to engage one or the other of said pluralities of drive teeth, a first trip tab coupled to said inner riser for moving said reversing mechanism to its first position, and a second trip tab coupled to said outer riser for moving said reversing mechanism to its second position, said trip tabs serving to reverse the direction of rotation of said nozzle assembly at angular positions determined by the relative angular displacement of said trip tabs.

9. The combination defined in claim 1, in which said internal assembly comprises a pop-up assembly which extends out of the tubular housing when water pressure is applied through the inlet- and which retracts back into the tubular housing when water pressure is relieved.

10. The combination defined in claim 9, in which said internal assembly rotates as a single member when driven by said drive means and is extended out from said tubular housing.

* * * * *